US005243925A

United States Patent [19]

Fortenberry

[11] Patent Number: 5,243,925

[45] Date of Patent: Sep. 14, 1993

[54] MODULAR BLADDER SYSTEM

[76] Inventor: John Fortenberry, 46 Walker St., New York City, N.Y. 10013

[21] Appl. No.: 890,092

[22] Filed: May 29, 1992

[51] Int. Cl.[5] ..... B63B 25/08

[52] U.S. Cl. ..... 114/74 A; 114/74 R; 114/74 T; 220/403

[58] Field of Search ..... 114/74 R, 74 T, 74 A, 114/256, 333, 69, 65 R, 72, 75, 121, 125, 257; 220/900, 901, 9.1, 562, 564, 4.12, 4.14, 403, 460, 461, 53; 405/210

[56] References Cited

U.S. PATENT DOCUMENTS

| | | | |
|---|---|---|---|
| 334,481 | 1/1886 | Sone . | |
| 3,067,712 | 12/1962 | Doerpinghaus | 114/74 T |
| 3,785,321 | 1/1974 | Backstrom | 114/74 R |
| 3,844,239 | 10/1974 | McLaughlin | 114/74 R |
| 3,922,985 | 12/1975 | Hamilton | 114/74 R |
| 4,117,796 | 10/1978 | Strain | 114/74 R |
| 4,135,465 | 1/1979 | Dudley et al. | 114/74 A |
| 4,227,477 | 10/1980 | Preus | 114/250 |
| 4,228,754 | 10/1980 | Shibata et al. | 114/74 R |
| 4,230,061 | 10/1980 | Roberts et al. | 114/74 R |
| 4,241,683 | 12/1980 | Conway | 114/74 R |
| 4,347,798 | 9/1982 | Gallagher | 114/74 R |
| 4,409,919 | 10/1983 | Strain | 114/74 R |
| 4,478,165 | 10/1984 | Strain | 114/74 R |
| 4,960,347 | 10/1990 | Strange | 405/63 |
| 4,982,678 | 1/1991 | Frederick | 114/74 R |
| 5,038,960 | 8/1991 | Seery | 220/403 |
| 5,040,693 | 8/1991 | Popp | 220/403 |

FOREIGN PATENT DOCUMENTS

| | | | |
|---|---|---|---|
| 1044549 | 4/1983 | U.S.S.R. | 114/74 T |

*Primary Examiner*—Robert J. Oberleitner
*Assistant Examiner*—Clifford T. Bartz
*Attorney, Agent, or Firm*—Jansson & Shupe, Ltd.

[57] ABSTRACT

The invention is a modular bladder system for confining a liquid cargo and carrying such cargo in a compartment of a transporter vessel. The cargo is confined in a modular plurality of bladders and cargo-filled bladders occupy substantially the entirety of the compartment volume. In one aspect, the system isolates ballast sea water and cargo without unduly limiting vessel cargo-carrying capacity. In event of an accidental hull penetration, the system limits the quantity of the potential spill and the modular bladders can be configured to substantially fill the compartments of a particular vessel.

15 Claims, 6 Drawing Sheets

MODULAR BLADDER SYSTEM

FIELD OF THE INVENTION

This invention is related generally to cargo transportation and, more particularly, to transportation of liquid cargo by vessel.

BACKGROUND OF THE INVENTION

Both in their number and per-incident quantity of spilled cargo, accidents attending shipment of liquid cargo by vessel have amply demonstrated the need for a way to at least reduce the quantity of spilled, potentially-polluting cargo. The most well-known recent accident involved the EXXON VALDEZ, a single hull vessel carrying crude oil.

The United States Coast Guard is understood to have estimated that had the EXXON VALDEZ had a double hull, 25% to 60% less oil would have been spilled. Others estimated the reduction in spilled quantity might have been as high as 75%.

Under United States law, double hulls are now required for certain types of new, cargo-carrying vessels. There are two common ways of "doubling" a ship's hull, namely, with a double bottom (protective in case of grounding) and with a double hull (double sides and double bottom—protective in case of collision or grounding).

But such "double" construction is extremely expensive, either in new vessel construction or in retrofit. However, it can be very effective. Some time ago, the United States Coast Guard studied 30 groundings occurring between 1969 and 1973. It concluded that a space between double bottoms of two meters (more than 6 feet) would have been effective in preventing inner bottom penetration with a 96% probability. But, of course, the loss in cargo space would be enormous.

Transportation of ballast, often sea water carried for stability when the vessel is otherwise empty, is also a consideration, at least in oil-carrying vessels. It is understood that oil tankers are required to have segregated ballast tanks which carry only sea water ballast and may not be used for cargo. Ballast tanks can comprise up to about one-third of the vessel's total capacity. Clearly, payload could be increased dramatically if space otherwise dedicated only to ballast could be used for "double duty" carrying.

And there is no prohibition against configuring a cargo vessel with spill-limiting systems which improve upon the performance of even a double hull vessel. But prior workers in this field have not been notably successful in configuring practical, highly-efficient and cost-effective systems.

For example, U.S. Pat. No. 334,481 (Sone) shows a vessel with rectilinear compartments transporting rigid cylinders of liquid cargo. U.S. Pat. No. 5,038,960 (Seery) shows a system having a flexible liner in each vessel compartment and a detached interior bladder which hold cargo. U.S. Pat. No. 4,230,061 (Roberts et al.) shows a cargo container extending across the width of a vessel. Multiple containers are arranged end-to-end along the length of the vessel cargo space. U.S. Pat. No. 4,982,678 (Frederick) shows two different types of ship hull liners which are reinforced for tear inhibition and nested one within the other.

An improved system which increases payload possibilities, limits the quantity of potential spills and can be adapted to any of a wide variety of vessel configurations would be a substantial advance in the art.

OBJECTS OF THE INVENTION

It is an object of this invention to provide an improved modular bladder system overcoming some of the problems and shortcomings of devices and systems of the prior art.

Another object of this invention is to provide an improved modular bladder system which more efficiently utilizes the carrying capacity of a vessel.

Another object of this invention is to provide an improved modular bladder system which limits the quantity of liquid cargo spilled in the event of a hull penetration.

Still another object of this invention is to provide an improved modular bladder system limiting economic waste of valuable ship's cargo.

Yet another object of this invention is to provide an improved modular bladder system readily adapted to any of a variety of vessel configurations.

These and other important objects will be apparent from the following descriptions taken in conjunction with the drawing.

SUMMARY OF THE INVENTION

A purpose of the inventive system is to limit the quantity of liquid cargo (and, particularly crude oil, chemicals and other pollutants) which can spill from a vessel if and when the hull is pierced. The new system includes one or more modular pluralities of cargo-carrying bladders in one or a combination of several arrangements in a cargo-carrying vessel. The selection of a particular arrangement is, in significant part, a function of vessel configuration. It may also be a function of the "perniciousness" of the cargo and of the most-likely type of hull damage, e.g., small-area "puncture-like" opening or long gash, which might occur.

The invention is an improvement in a system of the type having a flexible bladder for confining a liquid in a cargo transporter vessel such as a sea-going tanker. Such vessels typically have outboard and inboard compartments, the former having an outer hull wall and an inner wall common to an inboard compartment. The improved system has an outboard modular plurality of elongate bladders in an outboard ballast compartment. Each bladder has a major axis along the bladder longer dimension and a minor axis along a shorter dimension. When emptied, the bladders collapse to but a fraction of the volume occupied by them when filled with cargo.

By using plural bladders, there is a high likelihood that not all bladders would be ruptured in the event of hull damage and the quantity of cargo at risk of spillage through a damaged, penetrated hull is reduced. For liquid cargoes detrimental to the environment (and there are few cargoes that are not), environmental damage is very much reduced. And with marketable cargoes of all types, economic waste is reduced.

Further, by preventing the "pay" cargo from contacting the hull ballast compartment, ballast and cargo are always separated from one another. For ships that transport crude oil, even relatively small amounts of residual oil in the ballast compartment is never commingled with ballast sea water. And by making the ballast compartment do "double duty," the vessel may be more fully loaded with cargo.

This is in contrast with conventional arrangements where only ballast is carried in a ballast compartment.

When the vessel is loaded, such ballast compartments are empty and therefore, the "payload" capacity of the vessel is substantially reduced.

In one highly preferred arrangement, plural bladders are spaced from the outer wall of the vessel and have their major axes generally perpendicular, i.e., normal, to it. At least one bladder is adjacent to the outer wall and has its major axis generally parallel thereto. In another arrangement, each bladder in the outboard compartment has its major axis generally parallel to the outer wall.

The bladders in the outboard compartment need not be arranged so that some are spaced from the outer wall. In another arrangement, the bladders are stacked one atop the other in the outboard compartment and confined between the outer hull wall and the wall common to the adjacent inboard compartment. With this arrangement, each bladder in the outboard compartment preferably has a dimension, when filled with cargo, that is generally equal to the space between the hull wall and the common wall.

And bladders can be arranged in horizontally-disposed "layers" or tiers. In that instance, each tier replicates one of the arrangements described above. That is, each tier includes at least one bladder adjacent to the outer wall and oriented with its major axis generally parallel to the wall. Each of the plurality of bladders spaced from the outer wall has its major axis generally normal thereto.

While it is of substantial benefit if used only in outboard compartments, the improved system is not limited to such use. An inboard modular plurality of elongate, collapsible bladders may be confined in each of one or more vessel inboard compartments. In preferred arrangements, the major axes of such bladders are generally normal or parallel to the vessel's bottom.

Like those in an outboard compartment, the bladders in an inboard compartment may be arranged in vertically-disposed tiers. That tier adjacent to the hull bottom includes at least one bladder with its major axis generally parallel to the bottom. And such "lower tier" bladders may all be so oriented and, additionally, oriented with their major axes generally parallel to the keel.

In yet another arrangement, the major axes of bladders in the outboard compartment are generally normal to the major axes of bladders in the inboard compartment. In still another arrangement, the major axes of bladders in the outboard compartment are generally parallel to the outer hull wall and the major axes of bladders in the inboard compartment are generally normal to the outer hull wall.

Further details of the invention are set forth in the following detailed description taken in conjunction with the drawing.

DETAILED DESCRIPTIONS OF THE PREFERRED EMBODIMENTS

The inventive system 10 provides a unique solution to at least three considerations relating to liquid-cargo carrying. They involve limitation of spill quantity, isolation of ballast sea water and cargo and configuration of the system 10 to the compartments of a particular vessel.

Before describing the improved system 10, it will be helpful to understand the meaning of certain terms used in this specification. The phrase "modular plurality of bladders" (or like phrases) means at least two bladders configured so that when installed in a vessel compartment and filled with liquid, they substantially fill the compartment. An "outboard compartment" is a vessel compartment having one side bounded by or generally adjacent to an outer side wall or bulkhead of the vessel hull. Such outer hull walls are those extending along the length, rather than across the width, of the vessel. An "inboard compartment" is a vessel compartment having bulkheads o walls spaced from the outer walls of the vessel hull. Both outboard and inboard compartments have walls extending partially or entirely across the width of the hull.

It will also be helpful to understand that ballast compartments of sea-going vessels are typically disposed along the outer walls of a vessel hull rather than at its interior portion. In the instance of a double bottom or double hull vessel, the space between hulls serves as a ballast area. Such ballast compartment arrangements are described in a published article titled *Dealing With a Double Hull* which accompanies the specification and is incorporated herein by reference.

Figure 1:
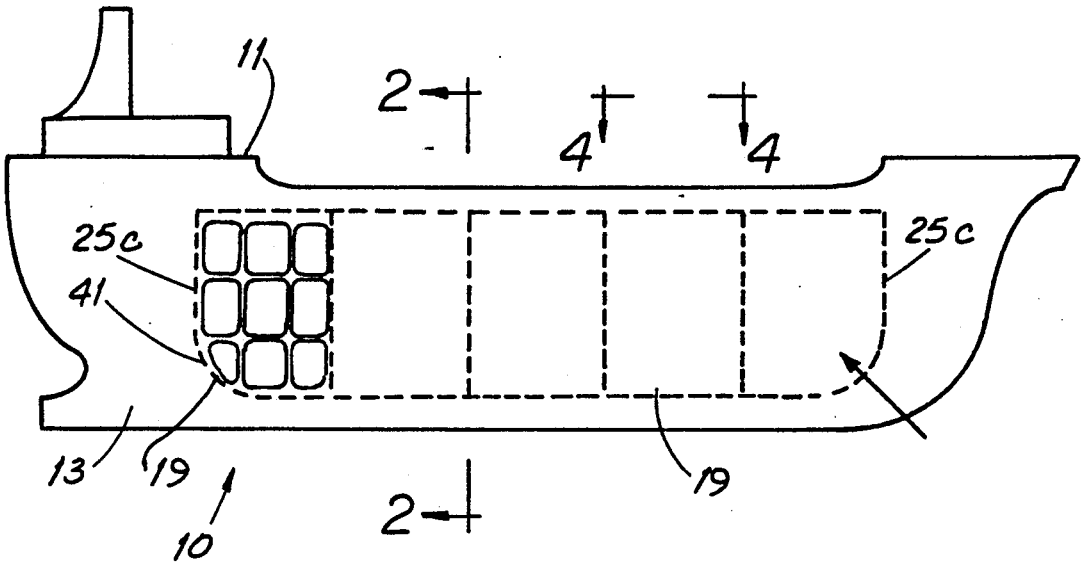
FIG. 1 is a side elevation view of a cargo transporting vessel with outboard compartments and modular bladders shown in phantom outline.
Figure 2:
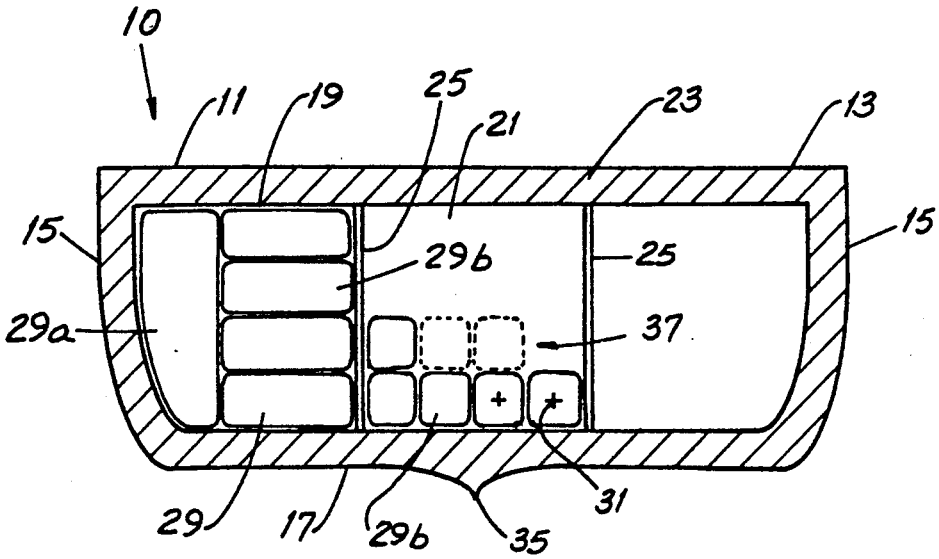
FIG. 2 is an elevation view of the vessel of FIG. 1 taken along the viewing plane 2—2 thereof, with portions omitted and showing one arrangement of modular bladders.
Figure 3:
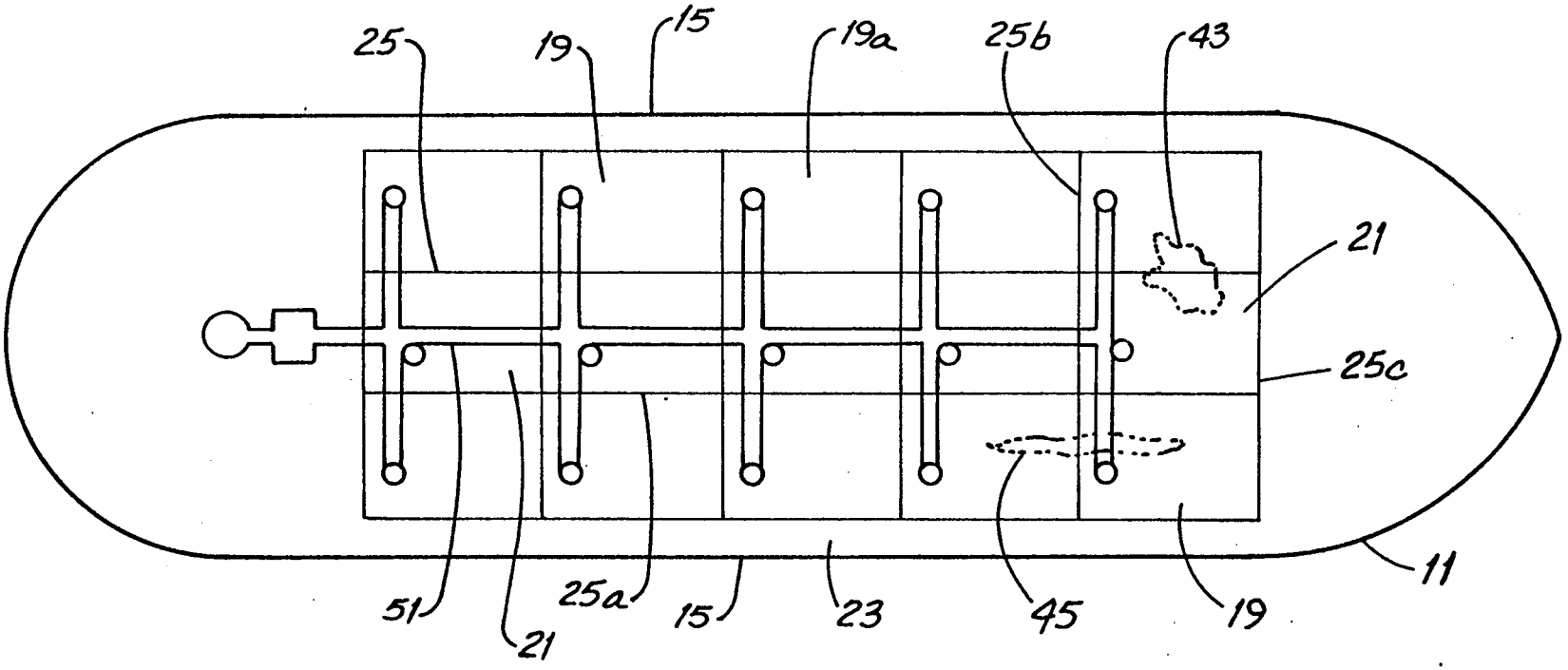
FIG. 3 is a top plan view of the vessel of FIG. 1 taken along the viewing plane 3—3 thereof and with hull-penetrating openings shown in dashed outline.

Referring to FIGS. 1, 2 and 3, an exemplary vessel 11 such as a sea-going crude oil tanker includes a hull 13 having outer hull walls 15, a hull bottom 17 and a plurality of outboard and inboard compartments 19 and 21, respectively. As shown in FIG. 3, the illustrated arrangement may be said to constitute a $3\times5$ matrix of compartments 19, 21. The compartments 19, 21 are bounded by the main deck 23, the hull 13 and by interior walls 25. As shown in FIG. 2, an interior wall 25 is common to an inboard compartment 21 and to an outboard compartment 19. Of course, in a configuration having four or more compartments 19, 21 across the width of the vessel 11, at least one interior longitudinal wall 25*a* is common to a pair of inboard compartments 21. Lateral interior walls 25*b* extend across the vessel 11 and but for the lateral end walls 25*c*, are common to pairs of outboard compartments 19 and/or inboard compartments 21.

Figure 4:
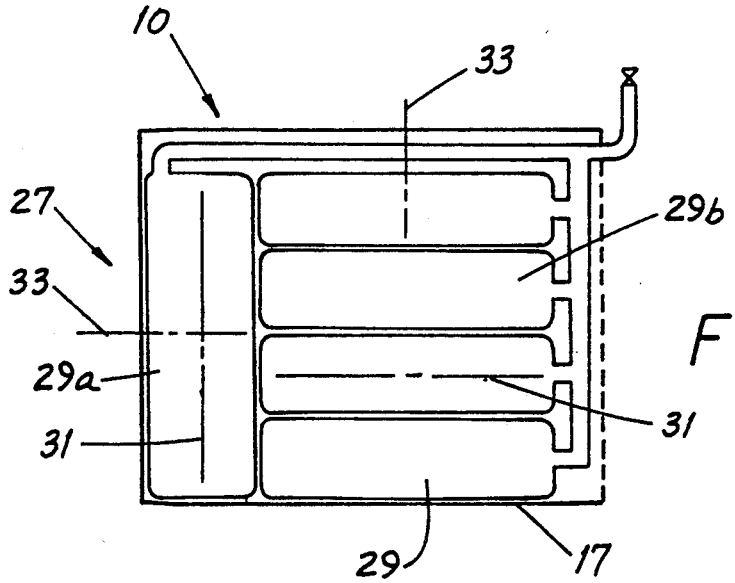
FIG. 4 is a top plan view of an outboard compartment of the vessel of FIG. 1 taken along the viewing plane 4—4 thereof and showing another arrangement of modular bladders.

Referring next to FIG. 4, an outboard compartment 19 is shown to include a modular plurality 27 of elongate bladders 29. Each bladder 29 is collapsible and has a major axis 31 along its longest dimension and a minor axis 33 along one of the shorter dimensions. In the arrangement of FIGS. 2 and 4, at least one bladder 29*a* is adjacent to the outer wall 15 and plural bladders 26*b* are stacked atop one another and spaced from such wall 15. The bladder 29*a* has its major axis 31 generally parallel to the wall 15 and normal to the hull bottom 17 while the major axes 31 of the bladders 29*b* are generally normal to the wall 15 and parallel to the hull bottom 17.

It should be appreciated that in the arrangements described above and following, there may be bladders 29 in each compartment 19, 21 in addition to those shown in the drawing. For example, in the outboard compartment 19 shown in FIGS. 2 and 4, one or more bladders 29*c* is behind the illustrated bladder 29*a* and one or more bladders 29*b* is behind each of the illustrated bladders 29*b*.

Figure 5:
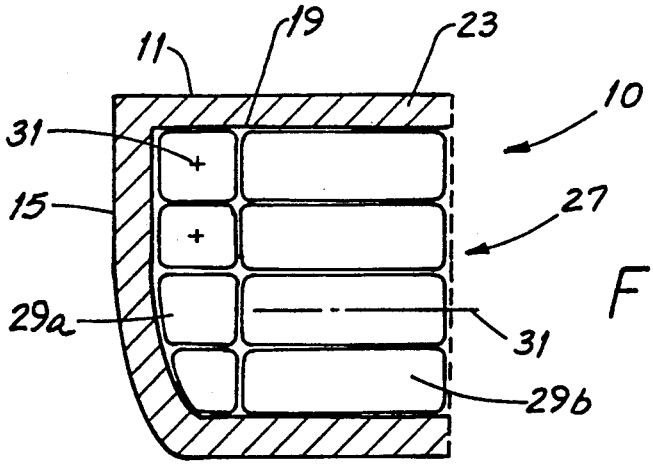
FIG. 5 is a view like that of FIG. 4 showing yet another arrangement of modular bladders.

The arrangement of FIG. 5 includes plural bladders 29*a* adjacent to the outer wall 15 but their major axes 31 are generally parallel to both the wall 15 and the bottom 17. Those bladders 29*b* spaced from the wall have their major axes 31 generally normal to the wall 15 and parallel to the bottom 17.

Figure 6:
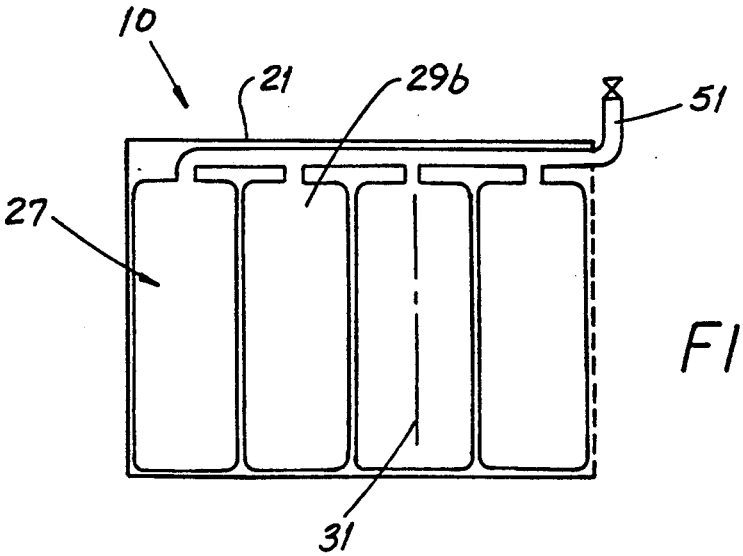
FIG. 6 is an elevation view of an inboard compartment of the vessel of FIG. 1 taken along the viewing plane 2—2 thereof and showing another arrangement of modular bladders.

Referring now to FIGS. 2 and 6, an inboard compartment 21 confines an inboard modular plurality 27 of elongate, collapsible bladders 29*b*. In FIG. 2, the major axes 31 of the bladders 29*b* are generally parallel to the hull bottom 17, to the walls 15 and to the vessel keel 35. The major axes 31 of those bladders 29*b* shown in FIG. 6 are generally normal to the bottom 17 and parallel to the walls 15.

It is likely that the vessel il will be fitted with "tiers" 37 of bladders 29 as shown in the inboard compartment 21 of FIG. 2. Each tier 37 has at least one bladder 29*b* adjacent to the bottom 17 and has its major axis 31 generally parallel thereto and to the keel 35.

Figure 8:
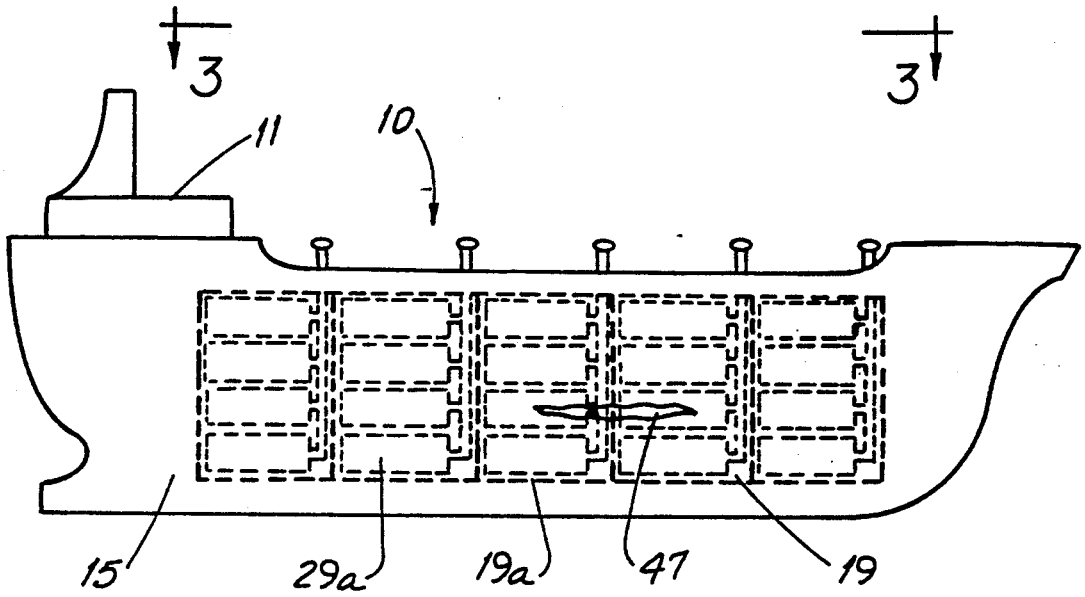
FIG. 8 is a side elevation view of a cargo transporting vessel with outboard compartments and bladders shown in phantom outline in another arrangement and showing a hull gash.
Figure 7:
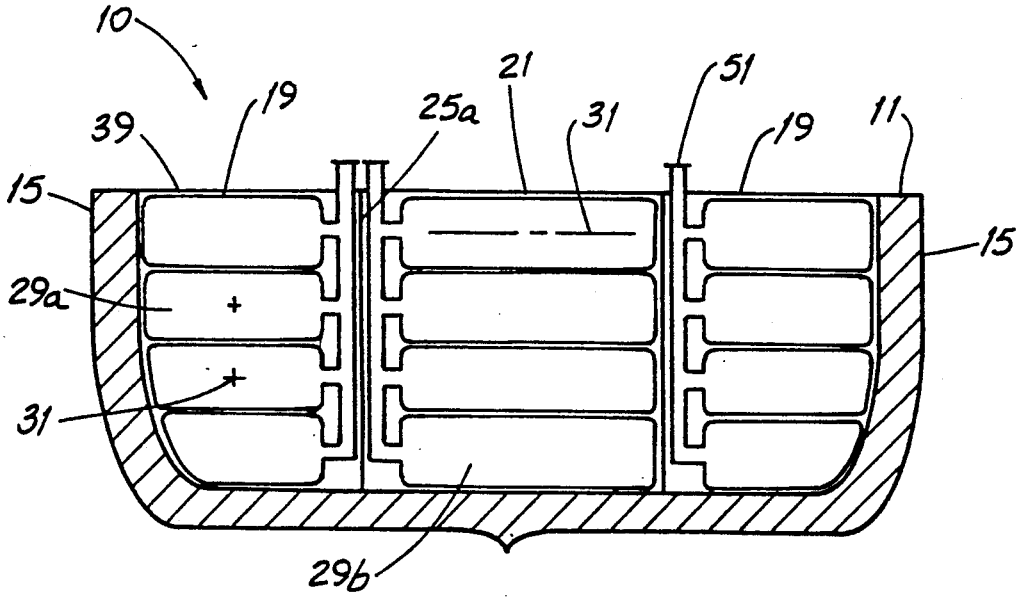
FIG. 7 is a view like that of FIG. 2 showing yet another arrangement of modular bladders.

FIG. 7 and 8 show an arrangement which differs from those shown in other figures in that each bladder 29*a* in an outboard compartment 19 has a dimension (as measured laterally across the width of the vessel 11) which is generally equal to the space 39 between the hull wall 15 and the common wall 25*a*. The bladders 29*a* extend along the outer wall 15 and generally along the length of the vessel 11. Those bladders 29*b* in the inboard compartment 21 extend laterally, i.e., their major axes 31 are generally normal to the outer walls 15 and normal to the major axes 31 of the bladders 29*a* in the outboard compartments 19.

Figure 9:
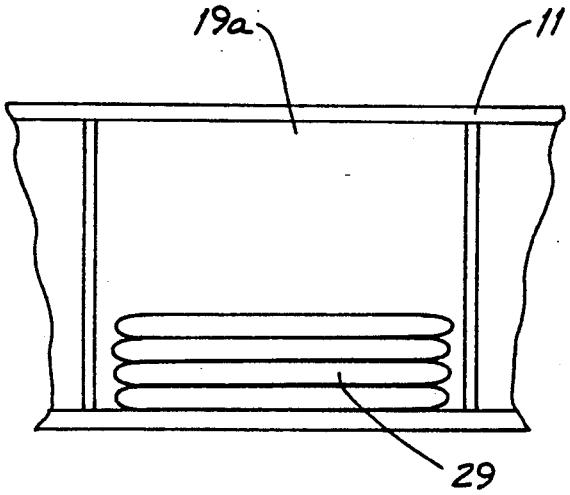
FIG. 9 is a side view of a ballast compartment of the vessel shown in, and viewed from the same perspective as, FIGS. 1 or 8.

Referring now to FIG. 9, it is assumed that an outboard compartment 19 as shown in FIGS. 3 and 8 is designated as a ballast compartment 19*a*, one of several such compartments 19*a* on a particular vessel 11. When the vessel 11 is travelling unloaded, the bladders 29 are empty and collapsed so as to occupy minimum space in the compartment 19*a* and the compartment 19*a* is filled with sea water. It is now apparent that even though the bladders 29 likely contain residual cargo, e.g., oil, such residual cargo and the sea water are maintained segregated from one another. The cargo does not come into contact with the vessel structure and when the sea water is exhausted at port prior to taking on cargo, such water does not pollute the port environs.

Figure 11:
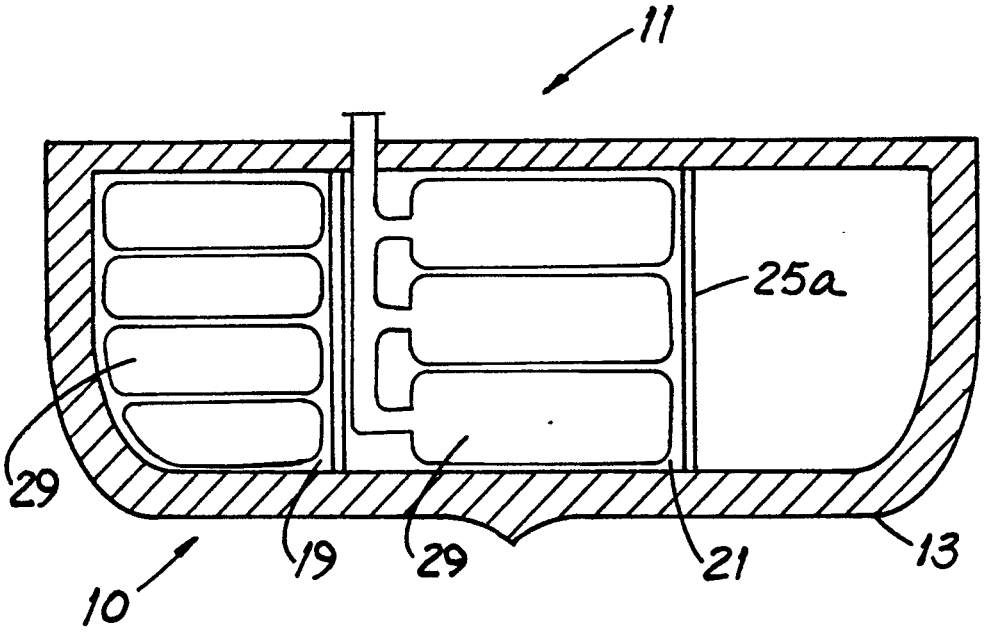
FIG. 11 is a view like that of FIG. 2 showing yet another arrangement of modular bladders.

And yet other arrangements are possible. Referring to FIGS. 3 and 11, it is assumed that each compartment 19, 21 has a length and a width as viewed from the perspective of FIG. 3. Each of at least two bladders 29 has a bladder length and a bladder width corresponding generally to the compartment length and compartment width, respectively. In the depiction of FIG. 11, the "compartment-size" bladders 29 are stacked in the compartments 19, 21. Cargo-filled bladders occupy substantially the entirety of the compartment volume and the bladders collapse when emptied. With this arrangement, an increased amount of product might be spilled in event of a bladder rupture but the cost of initializing the system in a vessel should be substantially lower.

From the foregoing, one will appreciate that modular pluralities 27 of bladders 29 in a compartment 19, 21 may take any of a variety of arrangements, both as to bladder size and shape and as to arrangement thereof. The following explains some of the factors influencing the arrangements.

Among the factors are the need to maximize the "pay" cargo, the configuration of the compartments 19, 21 of the particular vessel 11 and the degree to which the most pernicious cargo might pollute the environment if spilled. Since hull damage is a possibility, other factors include the type and degree of hull damage that might reasonably be expected to occur.

One way to maximize pay cargo is by omitting bladders 29 and placing cargo and ballast water alternately in the same compartments 19*a*. But such a choice is accompanied by risk of very substantial pollution in event of hull damage and by inevitable port pollution as ballast sea water is periodically exhausted.

On the other hand, the risk of a major spill can be minimized and the volume of a particular compartment 19, 21 (including its "nooks and crannies") can be substantially filled if individual bladders 29 are very small. Spillage would be minimized since the hull-invasive object, a rock or the like, would have to rupture a large number of bladders 29 to release a substantial quantity of cargo into the sea. But even the collapsed volume of a very large number of very small bladders 29 becomes significant because of the presence of an increased mass of material from which the bladders 29 are made.

As to compartment configuration, a rear compartment 19 of the vessel 11 of FIGURE I has an angled curve rear wall 25*c*. As shown, an advantageous feature of bladder "modularity" is that bladders 29 can be arranged (e.g., by using a smaller bladder 29 at the curvature 41) so that in the aggregate, their contained volume approximates that of the compartment 19.

With respect to hull damage, grounding accidents are believed to put the hull bottom 17 more "at risk" than the side hull walls 15. And a grounding accident could create a puncture-like hole 43 having a somewhat similar dimension in all directions or a relatively short gash-like opening 45. Both grounding and collision accidents can create long gash-like openings 47 in the hull bottom 17 or side wall 15, respectively. Such an opening 47 has a length which is, probably, several times greater than its width and extends generally longitudinally along the vessel hull 13 rather than laterally.

Merely to illustrate some of the implications of the type and degree of hull damage, consider a collision involving a gash-like opening 47 as in FIG. 8 and its effect upon the bladder arrangements of the outboard compartments 19 shown in FIGS. 2 and 5. If a vessel 11 had outboard compartment bladders 25 in the arrangement of FIG. 5, one or possibly two bladders 29 might be ruptured. On the other hand, if the arrangement of bladder 25*a* was like that of FIG. 2, the opening 47 may cut across the "midriff" of several vertically-oriented bladders 29*a* and the contents of a substantial number of bladders 29*a* would likely leak into the sea.

Figure 10:
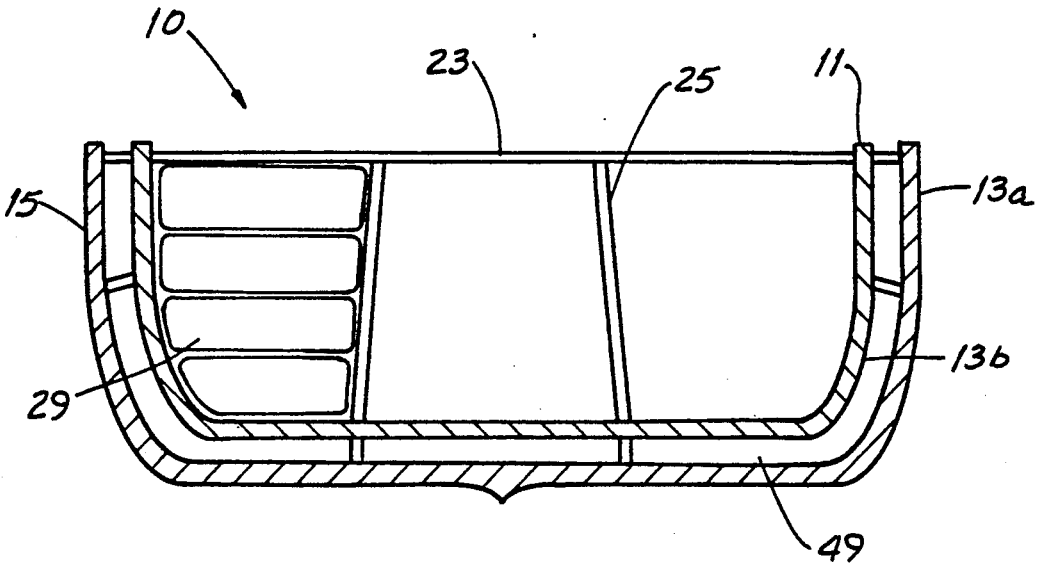
FIG. 10 is a view like that of FIG. 2 showing a double hull vessel with modular bladders in an outboard compartment.

The invention assumes a reasonable balance between the noted factors and any one or combination of factors can be given greater or lesser "weight," depending upon the vessel operating conditions. And referring to FIG. 10, it should be appreciated that the modular bladder system 10 can be used with vessels 11 having double hulls 13*a*, 13*b* and a space 49 between them. With the inventive system 10, the prospect of substantial spillage is minimized even though the hulls 13*a*, 13*b* are spaced more closely together than would be advisable in the absence of bladders 29. Double hull construction can be used without unnecessarily limiting the payload capacity of the vessel 11.

Certain of the figures, e.g., FIGS. 6 and 7, show piping networks 51 for filling the modular bladders 29 in sequence or simultaneously. A preferred network 51 includes check valves or other types of isolating devices (not shown) for preventing contents of an intact bladder 29 from flowing into (and out of) a ruptured bladder 29.

In this specification, reference is made to axes which are normal to one another. As used, such expression refers to axes which intersect and also refers to axes which would intersect if projected to the same plane.

While the principles of this invention have been described in connection with specific embodiments, it should be understood clearly that these descriptions are made only by way of example and are not intended to limit the scope of the invention.

I claim:

1. In a system using a flexible bladder for confining a liquid in a seagoing cargo transporter vessel having a keel and at least one inboard compartment and at least one outboard compartment bounded in part by an outer hull wall, the improvement comprising:

an outboard modular plurality of elongate bladders in an outboard ballast compartment, at least one such bladder being adjacent to the outer hull wall, such bladders being filled with liquid cargo and being flexible for substantially collapsing when emptied;

an inboard modular plurality of elongate bladders in an inboard compartment;

each bladder has a major axis and a minor axis which is shorter than the major axis;

at least one bladder of the inboard plurality of bladders has its longest axis generally parallel to the keel;

each of said inboard plural bladders has all bladder surfaces spaced from the outer wall by at least one bladder adjacent to the outer wall;

at least one bladder has its major axis generally parallel to the outer wall; and, the major axes of bladders spaced from the outer wall are generally normal to the outer wall, whereby the quantity of cargo at risk of spillage is reduced, ballast and cargo are separated and the vessel may be more fully loaded with cargo.

2. The system of claim 1 wherein the bladders are stacked one atop the other in the outboard compartment.

3. The system of claim 1 wherein the outboard and inboard compartments are defined by a common wall spaced from the outer hull wall and each bladder in the outboard compartment has a dimension generally equal to the space between the hull wall and the common wall.

4. The system of claim 1 wherein the outboard compartment includes tiers of bladders and each tier includes:

at least one bladder adjacent to the outer wall and having its major axis generally parallel thereto; and, a plurality of bladders spaced from the outer wall and having their major axes generally normal thereto.

5. The system of claim 1 wherein the outboard compartment has a length and a width, each of at least two bladders in the outboard compartment has a bladder length and a bladder width corresponding generally to the outboard compartment length and outboard compartment width, respectively, and bladders are stacked in the outboard compartment.

6. The system of claim 1 wherein the major axes of bladders in the outboard compartment are generally parallel to the outer hull wall and the major axes of bladders in the inboard compartment are generally normal to the outer hull wall.

7. The system of claim 1 wherein the vessel includes a hull bottom, the inboard compartment has tiers of bladders and that tier adjacent to the hull bottom includes at least one bladder having its major axis generally parallel thereto.

8. The system of claim 7 wherein the major axes of all bladders int he inboard compartment are generally parallel to the keel.

9. In a system using a flexible bladder for confining a liquid in a seagoing cargo transporter vessel having a keel and at least one inboard compartment and at least one outboard compartment bounded in part by an outer hull wall, the improvement wherein:

the outboard and inboard compartments are defined by a common wall spaced from the outer hull wall;

and the improvement comprises:

an outboard modular plurality of elongate bladders in an outboard ballast compartment;

each bladder in the outboard compartment has a dimension generally equal to the space between the hull wall and the common wall, at least one such bladder being adjacent to the outer hull wall and stacked atop another bladder, such bladders being filled with liquid cargo and being flexible for substantially collapsing when emptied;

an inboard modular plurality of elongate collapsible bladders in an inboard compartment;

each bladder has a major axis and a minor axis shorter than the major axis;

at least one bladder of the inboard plurality of bladders has its major axis generally parallel to the keel;

the major axes of bladders in the outboard compartment are generally parallel to the outer hull wall and the major axes of bladders in the inboard compartment are generally normal to the outer hull wall, whereby the quantity of cargo at risk of spillage is reduced, ballast and cargo are separated and the vessel may be more fully loaded with cargo.

10. In a system using a flexible bladder for confining a liquid in a seagoing cargo transporter vessel having a keel and at least one inboard compartment and at least one outboard compartment bounded in part by an outer hull wall, the improvement comprising:

an outboard modular plurality of elongate bladders in an outboard ballast compartment, at least one such bladder being adjacent to the outer hull wall, such bladders being filled with liquid cargo and being flexible for substantially collapsing when emptied; and an inboard modular plurality of elongate bladders in an inboard compartment;

each bladder has a major axis and a minor axis which is shorter than the major axis; 'at least one bladder of the inboard plurality of bladders has its longest axis generally parallel to the keel;

each of said inboard plural bladders has all bladder surfaces spaced from the outer wall by at least one bladder adjacent to the outer wall;

at least one bladder has its major axis generally parallel to the outer wall;

and wherein:

the vessel includes a hull bottom and the major axis of at least one bladder comprising the inboard plural bladders is generally normal to such bottom, whereby the quantity of cargo at risk of spillage is reduced, ballast and cargo are separated and the vessel may be more fully loaded with cargo.

11. In a system using a flexible bladder for confining a liquid in a seagoing cargo transporter vessel having a keel and at least one inboard compartment and at least one outboard compartment bounded in part by an outer hull wall, the improvement comprising:

an outboard modular plurality of elongate bladders in an outboard ballast compartment, at least one such bladder being adjacent to the outer hull wall, such bladders being filled with liquid cargo and being flexible for substantially collapsing when emptied; and an inboard modular plurality of elongate, collapsible bladders in an inboard compartment;

all bladders have a major axis and a minor axis shorter than the major axis;

at least one bladder of the inboard plurality of bladders has its longest axis generally parallel to the keel;

and wherein:

the major axes of bladders in the outboard compartment are generally normal to the major axis of bladders in the inboard compartment, whereby the quantity of cargo at risk of spillage is reduced, ballast and cargo are separated and the vessel may be more fully loaded with cargo.

12. In a system using flexible bladders for confining liquid cargo in compartments of a seagoing transporter vessel, the improvement wherein:

the cargo is confined in a modular plurality of bladders with plural bladders in each of plural compartments;

cargo-filled bladders occupy substantially the entirety of the volume of each compartment;

each bladder has a major axis; and, at least one bladder in each compartment is oriented with its major axis generally normal to the major axis of another bladder, whereby the quantity of cargo at risk of spillage is reduced and the compartment is substantially fully loaded with cargo.

13. The system of claim 12 wherein each compartment has a length and a width, each of at least two bladders in each compartment has a bladder length and a bladder width corresponding generally to its compartment length and compartment width, respectively and bladders are stacked in each compartment.

14. The system of claim 12 wherein the vessel has an outer hull wall and the major axis of at least one bladder in each compartment is generally normal the outer hull wall.

15. The system of claim 12 wherein the vessel has a hull bottom and a major axis of at least one bladder in each compartment is generally normal to the hull bottom.

* * * * *